United States Patent [19]

Barisoff

[11] 4,416,613

[45] Nov. 22, 1983

[54] BLOWPIPE TYPE OF BURNER

[76] Inventor: Leonard M. Barisoff, Box 104, Grand Forks, British Columbia, Canada, V0H 1H0

[21] Appl. No.: 175,380

[22] Filed: Aug. 5, 1980

[51] Int. Cl.[3] ..... F23D 15/02

[52] U.S. Cl. ..... 431/243; 431/351; 431/353

[58] Field of Search ..... 431/242, 243, 351, 353, 431/116

[56] References Cited

U.S. PATENT DOCUMENTS

| | | | |
|---|---|---|---|
| 1,374,045 | 4/1921 | Vezie | 431/116 |
| 2,804,918 | 9/1957 | Raymond et al. | 431/242 |
| 3,849,058 | 11/1974 | Pankow | 431/354 |
| 4,088,437 | 5/1978 | Holzapfel | 431/242 |

FOREIGN PATENT DOCUMENTS

| | | |
|---|---|---|
| 466261 | 7/1950 | Canada . |
| 876526 | 7/1971 | Canada . |
| 912435 | 10/1972 | Canada . |
| 954787 | 9/1974 | Canada . |

*Primary Examiner*—Carroll B. Dority, Jr.
*Attorney, Agent, or Firm*—Marcus & Associates

[57] ABSTRACT

A novel burner, e.g. for a gaseous fuel is provided herein. The burner is an improvement on the conventional hand-held blowpipe type of burner including a cylindrical housing, a nozzle body provided with a mixing chamber, an axial gas inlet port to the mixing chamber, a plurality of radial air inlet ports to the mixing chamber, and an axially extending burner tube connected to the mixing chamber. The mixed gas is substantially completely burned in the burner tube. The improvement is an add-on to the conventional burner and takes the form of a self-cooling shield. The shield includes a disc-like, centrally apertured baffle secured at the extreme forward end of the cylindrical housing with the axially extending burner tube projecting through the central aperture thereof. The shield also includes an outer tubular member, secured concentrically to the cylindrical housing by a disc-like centrally apertured rear wall, the central aperture surrounding the cylindrical housing and being secured thereto. This provides the outer tubular shield as having a closed rear end and an annular open forward end. The shield also includes an inner tubular member secured concentrically within the outer tubular shield and to the disc-like baffle by a plurality of bracing connections. This provides the inner tubular member as having an annular open rear end and a circular open forward end. The outer tubular member and the inner tubular member define therebetween, an annular chamber for backflow of cooling air. The rear wall of the outer tubular member and the disc-like baffle define, therebetween, a rear cylindrical chamber.

2 Claims, 2 Drawing Figures

BLOWPIPE TYPE OF BURNER

BACKGROUND OF THE INVENTION (i) Field of the Invention

This invention relates to hand-held welding torches. More particularly, it relates to a hand-held, self-cooling, gas welding torch using, e.g., propane gas.

(ii) Description of the Prior Art

It is well known that hand-held torches which produce a flame for welding or other purposes become hot. It was proposed in the past to overcome this problem by providing a water-cooled shield around the flame. For example, in the burner taught by Canadian Pat. No. 466,261 issued July 4, 1950 to J. M. Crowe, a water jacket extended throughout the length of the burner body. Also, Canadian Pat. No. 876,526 issued July 27, 1971 to K. Kunioka et al. provided a multi-outlet oxygen fuel blowing lance in which the oxygen blowing pipe was enveloped along its length by cooling water flowing in a cooling mantle.

The provision of air chambers around the burner nozzle has also been suggested. For example, Canadian Pat. No. 954,787 issued Sept. 17, 1974 to W. E. Troyer disclosed a welding gun nozzle in which a fume-extracting chamber was formed concentric with a conventional nozzle. Such chamber had its orifice to designed as to draw in fumes from a region laterally outward from the nozzle. The patented welding gun provided included a nozzle for use in operations where smoke or fumes are created. The first member included a first passageway therethrough. A second member was provided which was coaxial with and surrounded the first member and was spaced radially therefrom along an axis to define a chamber therebetween into which smoke or fumes may be drawn. The second member had an end spaced from the end of the first member along the axis. Means were positioned between the end of the first member and which extended outwardly from the first member a distance substantially equal to the distance of radial spacing of the second member. That means provided a substantially continuous opening forming the sole interconnection from external of the nozzle to the chamber. Means were also provided for connecting the chamber to a source of negative pressure whereby air flow into the opening would remove smoke or fumes from a region laterally outwardly of such opening.

While the patentee did teach that his welding gun also includes means for cooling a welding gun employing the fume-extracting nozzle which allows a welding gun and those hoses used to be made of smaller and lighter material and yet have the long life, such means were not self-operating. The means did require a source of vacuum. While it was stated that, along with the fumes, the nozzle also drew in ambient air in large quantities, and as a result, the nozzle was said actually to operate at cooler temperatures than conventional nozzles, the burning characteristics were not improved.

SUMMARY OF THE INVENTION (i) Aims of the Invention

An object, therefore, of this invention is to provide a new improved gas hand torch which is self-cooling without the addition of external sources of cooling fluid.

Another object of this invention is to provide such a torch in which the cooling air is also used as the combustion-supporting gas.

(ii) Statement of Invention

The present invention now provides an improvement in a conventional hand-held blowpipe type of burner which burner includes a cylindrical housing, a nozzle body provided with a mixing chamber, an axial gas inlet port to the mixing chamber, a plurality of radial air inlet ports to the mixing chamber, and an axially extending burner tube connected to the mixing chamber, whereby mixed gas is substantially completely burned in the burner tube, the improvement, in combination with the burner, of a self-cooling shield, the shield comprising: (a) a disc-like, centrally apertured baffle secured at the extreme forward end of the cylindrical housing, and having the axially extending burner tube projecting through the central aperture; (b) an outer tubular member, secured concentrically to the cylindrical housing by a disc-like centrally apertured rear wall, the central aperture surrounding the cylindrical housing and being secured thereto, thereby to provide the outer tubular shield as having a closed rear end and an annular open forward end; (c) an inner tubular member secured concentrically within the outer tubular shield and to the disc-like baffle by a plurality of bracing connections, thereby to provide the inner tubular member as having an annular open rear end and a circular open forward end; (d) the outer tubular member and the inner tubular member defining, therebetween, an annular chamber for back-flow of cooling air; and (e) the rear wall of the outer tubular member and the disc-like baffle defining, therebetween, a rear cylindrical chamber; whereby cooling air is drawn in laminar flow into the annular chamber from the annular open end of the outer tubular member to the rear cylindrical chamber, where the air is bifurcated into two flows, a first air flow to provide combustion-supporting air to the radial air inlets, and a second air flow to enter the annular open rear end of the inner tubular member, through an annular zone within, and along the wall of, the inner tubular member.

(iii) Other Features of the Invention

By a feature of this invention, the inner tubular member projects forwardly beyond the outer tubular member.

BRIEF DESCRIPTION OF THE DRAWINGS

In the accompanying drawings.

DESCRIPTION OF PREFERRED EMBODIMENT

Figure 1:
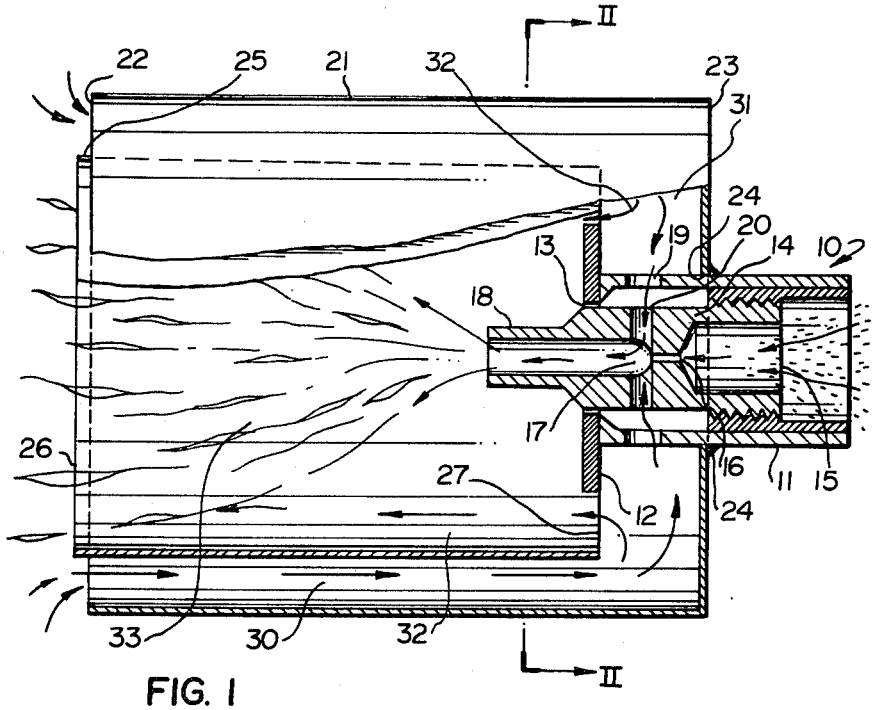
FIG. 1 is a central longitudinal section through one embodiment of the torch of this invention.
Figure 2:
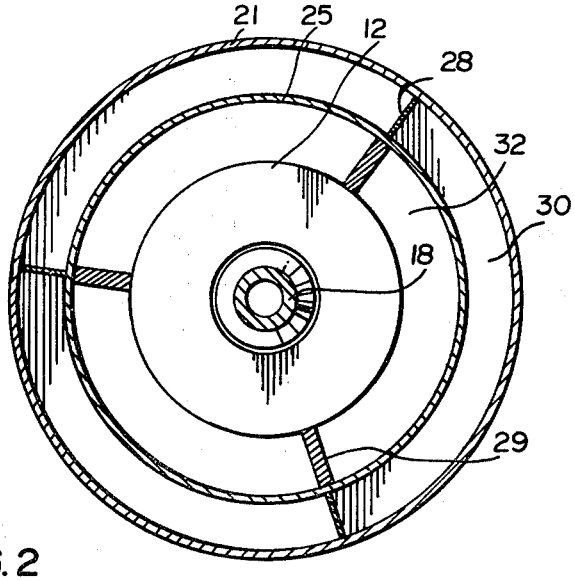
FIG. 2 is a section through the line II—II of FIG. 1.

As seen in the drawings, the conventional hand-held torch 10 includes a cylindrical housing 11 provided with a disc-like front baffle 12 having a central aperture 13 therein. Within the housing 11 is a nozzle body 14 having an axial gas inlet port 15 leading through an axial inlet aperture 16 to the mixing chamber 17. The gas, e.g., butane, is mixed with air entering through a pluraity of radial air inlet ports 19 in the housing 11 connecting with a plurality of radial inlet ports 20 in the nozzle body 10. The mixing chamber 17 leads to an axially extending burner tube 18 where the mixed gas is substantially completely burned, as in any conventional hand-held blowpipe type of burner.

Secured to the nozzle housing 11 is an outer cylindrical tubular member or shield 21 having an open forward end 22 closed off by a rear end wall 23 which is secured to the nozzle housing 11 at a central aperture 24 by suitable means, e.g., by welding. An inner cylindrical concentric tubular member or shield 25 having an open forward end 26 and an annular open rear end 27 spaced from the disc-like baffle 12 is secured to the outer shield 21 by means of a plurality of longitudinally extending braces 28, and to the disc-like baffle 12 by a plurality of bracing connections 29. An annular chamber 30 is thus provided between the outer tubular shield 21 and the inner tubular shield 25. In addition, a rear cylindrical chamber 31 is provided leading from the annular chamber 30 to the radial air inlet ports 19 and to the annular open rear end 27.

OPERATION OF PREFERRED EMBODIMENT

In operation, the air for combustion and for cooling is drawn in via the annular chamber 30. The air thus simultaneously provides a cooler outer wall of the outer tubular shield 21 and becomes heated to augment the combustion of the propane gas. A portion of the drawn-in air is also expelled through annular end 27 as an annular gaseous shield 32 between the outer wall of the inner tubular shield 25 and the central flame 33. In this way, a self-cooling, hand-held propane torch is provided in which the combustion is more efficient because of the preheating of the combustion-supporting air.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What I claim is:

1. A blowpipe type of burner including a cylindrical housing, a nozzle body provided with a mixing chamber, an axial gas inlet port to said mixing chamber, a plurality of radial air inlet ports to said mixing chamber, and an axially extending burner tube connected to said mixing chamber, whereby mixed gas is substantially completely burned in said burner tube, the improvement, in combination with said burner, of a self-cooling shield, said shield comprising:

(a) a disc-like, centrally apertured baffle secured at the extreme forward end of said cylindrical housing, and having said axially extending burner tube projecting through said central aperture;

(b) an outer tubular member, secured concentrically to said cylindrical housing by a disc-like centrally apertured rear wall, said central aperture surrounding said cylindrical housing and being secured thereto, thereby to provide said outer tubular member as having a closed rear end and an annular open forward end;

(c) an inner tubular member secured concentrically within said outer tubular shield and to said disc-like baffle by a plurality of bracing connections, thereby to provide said inner tubular member as having an annular open rear end and a circular open forward end;

(d) said outer tubular member and said inner tubular member defining, therebetween, an annular chamber for back-flow of cooling air;

(e) the rear wall of said outer tubular member and said disc-like baffle defining, therebetween, a rear cylindrical chamber; and (f) said cylindrical housing having aperture means communicating said rear cylindrical chamber with said radial air inlet ports of said mixing chamber whereby cooling air is drawn in laminar flow into said annular chamber from the annular open end of said outer tubular member to said rear cylindrical chamber, where said air is bifurcated into two flows, a first air flow to provide combustion-supporting air to said radial air inlets, and a second air flow to enter the annular open rear end of said inner tubular member and then to be expelled, along with hot gaseous products of combustion, through an annular zone within, and along the wall of, said inner tubular member.

2. The burner of claim 1 wherein said inner tubular member projects forwardly beyond said outer tubular member.

* * * * *